United States Patent [19]

Kowalik et al.

[11] 4,144,426

[45] Mar. 13, 1979

[54] SINGLE BARREL PUFFER CIRCUIT INTERRUPTER WITH DOWNSTREAM GAS COOLERS

[75] Inventors: Peter M. Kowalik, Penn Township, Allegheny County; Stanislaw A. Milianowicz, Monroeville, both of Pa.

[73] Assignee: Westinghouse Electric Corp., Pittsburgh, Pa.

[21] Appl. No.: 768,939

[22] Filed: Feb. 15, 1977

[51] Int. Cl.[2] ..... H01H 33/88

[52] U.S. Cl. ..... 200/148 A; 200/148 C

[58] Field of Search ..... 200/148 A, 150 G, 148 C

[56] References Cited

U.S. PATENT DOCUMENTS

| | | | |
|---|---|---|---|
| 2,481,996 | 9/1949 | Grunewald et al. | 200/148 C |
| 3,946,183 | 3/1976 | Milianowicz | 200/148 A |

FOREIGN PATENT DOCUMENTS

| | | | |
|---|---|---|---|
| 676353 | 6/1939 | Fed. Rep. of Germany | 200/148 C |

*Primary Examiner*—Robert S. Macon

*Attorney, Agent, or Firm*—M. J. Moran

[57] ABSTRACT

A single barrel puffer circuit breaker apparatus is taught in which compressed sulfur hexafluoride gas is forced into the region of an arc. The arc is struck between hollow, cylindrical conductors during a circuit breaker opening operation. The heated gas is exited from the region of the arc by way of the internal portion of the hollow conductors. At the other ends of the hollow conductors the gas is vented into enlarged regions which are partially bounded by the single barrel. The single barrel provides the multiple functions of support, insulations and gas storage. Gas coolers are provided, one of which may cool the hot gas as it radially diffuses therethrough and the other of which may cool hot gas as it transversely diffuses therethrough. The coolers tend to reduce the energy of the gas by reducing its temperature and consequently its pressure, thus assisting in protecting the inner surface of the single barrel from charring and protecting the entire barrel from rupturing.

12 Claims, 2 Drawing Figures

SINGLE BARREL PUFFER CIRCUIT INTERRUPTER WITH DOWNSTREAM GAS COOLERS

CROSS REFERENCE TO RELATED APPLICATIONS

This invention is related to those disclosed in copending, concurrently filed applications Ser. No. 769,140 and Ser. No. 769,139.

BACKGROUND OF THE INVENTION

1. Field of the Invention

The subject matter of this invention relates generally to puffer circuit breaker interrupters and relates more particularly to single barrel puffer circuit breaker interrupters with downstream gas coolers.

DESCRIPTION OF THE PRIOR ART

It is known to utilized puffer type compressed gas circuit interrupters having elongated cylindrical barrels or tubes where sulfur hexafluoride gas is provided to the region of an electric arc to quench and cool the arc. The heated gas is thereafter exhausted through a hollow tube or the like to a region of gas storage within the cylindrical tube. Generally, a second tube is provided for assisting in the puffing or gas compressing operation. This tube operates in conjunction with a movable piston which in turn operates in conjunction with the circuit breaker operating mechanism and movable contact. Such apparatus is taught in U.S. Pat. No. 3,852,551, issued Dec. 3, 1974 to C. W. Cleaveland. It is also known to provide vented gas coolers for electrical fuses. In this case, the exhaust gas from an expulsion type fuse is provided into the region of a cooler where water is condensed therefrom and where some of the energy of the exhausted gas is thus expended. The gas may then be provided to an external environment for final dissipation. It would be advantageous to provide a circuit breaker apparatus having a cooler so that the hot exhaust gas from the region of the arc could be cooled, thus reducing its energy.

SUMMARY OF THE INVENTION

In accordance with the invention, puffer circuit breaker apparatus is taught which includes a single barrel in which functions or operates a separable main contact and a puffer piston. The contacts are hollow and cylindrical. Consequently, puffer gas which is provided into the region of the contacts for extinguishing the arc drawn therebetween as the contacts open is exhausted or exited from that region by movement through the internal portion of the hollow cylindrical contacts. As the gas vents through the exit ends of the aforementioned contact tubes, it either radially or transversely diffuses through a copper mesh cooler where the energy thereof is reduced in terms of both temperature and pressure. Consequently, the gas which reaches the region of the inside wall of the single tube is lowered in terms of both temperature and pressure, thus reducing the thermal and mechanical stress on the inside wall of the barrel.

BRIEF DESCRIPITON OF THE DRAWINGS

For a better understanding of the invention, reference may be had to the preferred embodiment thereof shown in the accompanying drawings, in which:

FIG. 1 shows a puffer circuit breaker apparatus partially in section, partially broken away, and partially in block diagram form; and FIG. 2 shows a broken away section of a portion of the interior wall of the support and insulating cylinder for the circuit breaker apparatus of FIG. 1.

DESCRIPTION OF THE PREFERRED EMBODIMENTS

Figure 1:
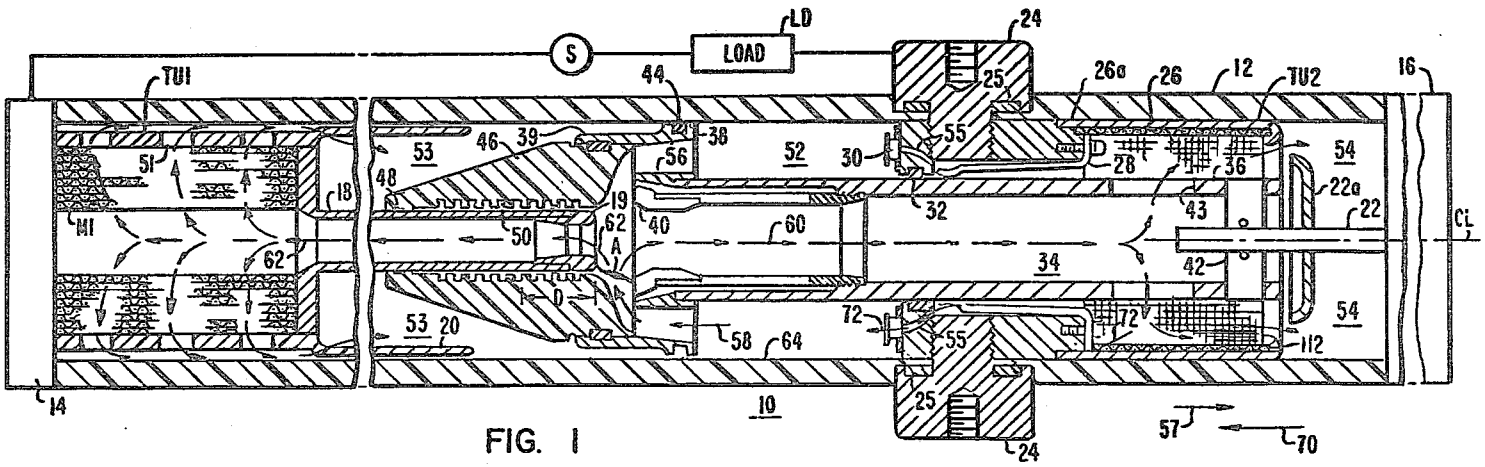

Referring now to the drawings and FIG. 1 in particular, a single tube puffer circuit interrupter 10 is shown. The puffer circuit interrupter or circuit breaker 10 may include a hollow cylindrical insulating support tube 12, the purpose of which will be described in more detail hereinafter. Support tube 12 has an electrically conducting terminal 14 on the left portion thereof and has an operating mchanism 16 on the right portion thereof as viewed in FIG. 1. The insulating support tube 12 may be radially symmetrical about a centerline CL. A hollow, generally cylindrical electrical conductor 18 is shown in the left portion of circuit breaker apparatus 10. The hollow conductor 18 is interconnected electrically with the terminal 14 through a conducting cooler tube TU1, the purpose of which will be described in detail hereinafter. At the right end of the hollow electrical conductor 18 is an arcing contact piece 19 which may comprise any suitable electrically conductive material which will withstand repeated arcing for a relatively long period of time for many operations. Flexible main conducting fingers 20 are also connected to terminal 14 by way of cooler tube TU1. Interconnected with the operating mechanism 16, shown schematically to the right of FIG. 1, is a movable connecting rod 22, the use of which will be described more fully hereinafter. Disposed on either side (top and bottom as viewed in FIG. 1) of the electrically insulating support tube 12 may be electrically conductive terminals 24. Each electrically conductive terminal 24 may be seated and sealed in an appropriate groove or seat 25 in the insulating support member 12. A portion of the electrically conductive terminal 24 protrudes through the insulating support tube 12 and is threaded into an internal connector and support piece 26 for securing the terminal 24 against the inside wall of the insulating support tube 12 in electrically conducting relationship with the internal conductor 26. Disposed on the internal conducting member 26 may be a plurality of electrically conducting flexible fingers 28 and at least one unidirectional gas valve 30. The use of the latter two elements will be described more fully hereinafter. Also disposed on the internal conducting member 26 may be a neoprene seal 32 or the like. The use of the neoprene seal 32 will be described more fully hereinafter with respect to other portions of the apparatus. A cooler tube TU2 is interlocked against the inside wall of the support tube 12 at **26*a* on the support piece 26. The use of tube 12** will be described more fully hereinafter.

There is provided a movable electrical contact assembly 34 which includes a generally cylindrical hollow electrically conducting tube member 36. The electrically conducting tube member 36 may be radially disposed symmetrically about the previously-described centerline CL. Disposed at the left end of the electrically conducting movable tube member 36 is a conducting flange 38 having an extended electrically conducting portion 39 which is adapted to make sliding electrical contact with the previously described main contact fingers 20 when the puffer circuit breaker 10 is closed.

Also disposed on the left portion of the hollow conductive tube member 36 may be flexible contact fingers 40 which are complementary to the contact piece 19 described previously. On the right portion of the electrically conducting hollow cylindrical tube 36 is disposed a yoke 42 which is mechanically interconnected with the connecting rod 22 such that movement of the connecting rod 22 in the direction 70 in response to an appropriate action in the operating mechanism 16 will cause the entire body of the hollow conducting tube member 36 to move to the left to thus place the arcing contact fingers 40 in a disposition of overlapping electrical contact with the arcing contact 19 and to place the extended portion 39 of the conducting flange 38 in a disposition of electrical contact with the main contact fingers 20. It is to be noted that in this particular embodiment of the invention the relative longitudinal disposition of the contact fingers 20, the extended portion 39, the contact piece 19, and the contact fingers 40 is such that electrical contact is made during a circuit breaker closing operation between the contact piece 19 and the contact fingers 40 before electrical contact is made between the contact fingers 20 and the extended portion 39. Likewise, in an opening operation, the contact fingers 20 and the extended portion 39 separate before the contact piece 19 and the contact fingers 40 separate. The amount of overlap between fingers 40 and contact 19 is represented by D. The fingers 40 are joined at the roots thereof so that the inner regions of tubes 18 and 36 are sealed off from chamber 52 when the circuit breaker 10 is in the closed state. There is provided a neoprene seal 44 on the outer portion of the contact flange 38. The seal operates against the inner surface of the insulating support tube 12 to thus locally isolate two gas pressure regions which will be described hereinafter. In a like manner, the previously described seal 32 operates against the hollow conducting tube 36 to locally isolate one of the previously described gas pressure regions from a third gas pressure region.

There may be disposed to the right of the electrically conducting cylinder 36 an opening 43 which provides communication between the internal portion of the hollow conducting tube 36 and the region surrounding the external portion of the hollow conducting tube member 36 to the right of the seal 32.

There is provided an arc nozzle 46, the right portion of which is disposed on the previously described conducting flange 38. Nozzle 46 is supported at the left portion thereof in sealed but movable relationship against the outer surface of the previously described hollow conductor 18. The seal 18 cooperates with the previously described seal 44 to provide the first two previously described regions of different gas pressure during the operation of the circuit interrupter apparatus 10. In a preferred embodiment of the invention, nozzle 46 always remains in sealed relationship with tube 18 thus providing an arc shield between the arcing contacts 19 and 40 and the inner surface of wall 12 during an arcing operation. On the internal portion of the arc nozzle 46 may be disposed a corrugated or ridged region 50 which provides high arc tracking resistance during the circuit breaker opening operation.

There is provided a first gas pressure region 52 which may exist between the seals 32 and the combined seals 44 and 48. Gas pressure is built up in the region 52 during a circuit breaker opening operation as will be described more fully hereinafter. A second gas pressure region 53 may exist between the left end of the circuit breaker apparatus 10 and the combined seals 44 and 48. Openings 51 disposed in the cooling tube TU1 provide paths of communication between the latter region 53 and the internal portion of the hollow conductor 18. A third gas pressure region may exist in the right portion of the circuit breaker apparatus between the seal 32 and the right side of the circuit breaker apparatus 10. The previously described opening 43 provides a path of gas communication between the internal portion of the hollow conducting tube 36 and the region 54. All of the latter described gas pressure regions contain gas of relatively different pressure during certain portions of the operating cycle of the circuit breaker 10. The pressure in each case is related to the relative sizes of openings 51 and 43 for example. The relative gas pressures in the latter-named regions 52, 53 and 54 during opening and closing of the circuit breaker apparatus provide the puffer action which will be described hereinafter. There is provided in the conducting flange 38 an opening 56 which communicates with the previously described region 52 and with the internal portions of both of the hollow conducting members 18 and 36. The communicating path previously described is conveniently located such that the contact fingers 40 and the contact piece 19 are disposed therein during a circuit breaker opening or closing operation. The previously described flexible fingers 28 provide a path of electrical conduction between the movable hollow conductive tube 36 and the internal conductor 26. A source of electrical power S may be serially or otherwise connected with a load LD which is to be protected by the circuit breaker apparatus 10. Such an arrangement is shown schematically in FIG. 1. The serial arrangment is interconnected with the terminal 14 and the terminal 24. Cooling tube TU1 encloses a cooling mesh M1 through which hot gas following path 62 may exhaust radially into region 53 by way of openings 51. Likewise, cooling tube TU2 encloses a cooling mesh M2 through which hot gas following path 60 may be diffused laterally by way of opening 43. In the latter case, a deflector **22*a* is positioned on rod 22 to aid in channeling a portion of the gas in path 60** into the mesh M2 for lateral diffusion therethrough.

OPERATION OF THE PUFFER CIRCUIT BREAKER APPARATUS 10

During the closing operation of the circuit breaker apparatus 10, the connecting rod 22 forces the hollow conducting tube 36 to the left as viewed in FIG. 1. Electrical continuity is maintained between the terminals 24 and the moving conducting cylinder 36 by way of the internal conductor or connector 26 and the fingers 28. As the cylinder 36 moves to the left, the flange 38, the nozzle 46 and the contact fingers 40 also move to the left. The movement of the flange 38 to the left causes the volume of the region 52 to enlarge, thus creating a local short term pressure differential between region 52 and regions 53 and 54 such that gas from region 54 moves through valve 30 by way of a channel 55 along the path 72 to region 52. Gas from regions 53 and 54 may move into region 52 by way of opening 56 until portion 41 of fingers 40 overlaps contact 19 thus closing off orifice 56 from regions 53 and 54. This charges region 52 with puffer gas ($SF_6$ for example) during the circuit breaker closing operation, it being understood that the unidirectional valve 30 opens to pass gas only in the direction 72 and closes to prevent gas from passing therethrough in the opposite direction.

As the movable contact assembly 34 continues movement to the left, a position is reached where the contact fingers 40 make electrical contact with the contact piece 19 on the hollow conductor 18. A short time thereafter the extended contact region 39 makes electrical contact with the main contact fingers 20. In this position the circuit which includes the load LD and the source S is closed through the puffer circuit breaker 10.

In a contact opening operation the contact rod 22 moves in the direction 57, thus causing the hollow conductive tube 36 of the movable contact assembly 34 to move to the right. The main contact fingers 20 and the extended contact region 39 of the conducting flange 38 disengage first. Movement of the flange 38 and nozzle 46 in the direction 57 through the distance D forces the trapped gas in the region 52 to become pressured by the reduction in volume in region 52. The latter movement through the region D is sometimes referred to as "lost motion" movement. Eventually a point is reached during the contact opening cycle where the contact piece 19 of the generally stationary hollow conductor 18 and the contact fingers 40 of the movable contact assembly 34 disengage under load or overload current or the like, thus generating an arc A. The pressurized gas in region 52 follows path 58 through opening 56 and is puffed or forced into the region of the arc A for quenching and cooling the arc A and for blowing the arc A out from between the contact piece 19 and the contact fingers 40. The heated gas may then follow path 62 into the hollow conductor 18, radially through the cooling mesh M1, through the openings 51 of the tube TU1 and into the region 53. Alternatively or concurrently the heated gas may follow the path 60 through the internal portion of the cylinder 36 and out through the holes 43 to be diffused laterally of the centerline CL through the mesh M2 and into the region 54. The relation between the diameter of the orifice through the contact 19, the internal diameter of the tube 12, and the velocity of the piston 38 are chosen so that the volume of space 53 increases appreciably faster than gas can flow into the space through the central orifice of the contact piece 19. The result is a reduction in gas pressure in the space 53 and an increase in the pressure drop across the central orifice of the contact 19, which increases interrupting ability.

After the arc A has been extinguished, the movable contact assembly 34 continues movement to the right in the direction 57 until a stable opened position is reached. The puffer circuit breaker apparatus 10 is in this position ready for a closing or reclosing operation. The pressure in the three gas regions 52, 53, 54 becomes equalized if such has not occurred earlier in the opening cycle. It is to be noted with respect to the arc A that the openings 56 in the conducting flange 38 provide a path whereby the arc current A may impinge upon the inner surface of the insulating support tube 12. In a like manner, the heat of the arc A may follow the same path and raise the temperature of the inner surface of the insulating support tube 12. Furthermore, the arc products produced by the interaction of sulfur hexafluoride gas for example and the electrical arc A may contact the inner surface of the insulating support member 12. These arc products may be carried along the path 62 or along the path 60 to the regions 53 and 54, respectively. The latter regions are adjacent to the inner surface of the insulating support tube 12. It is to be noted that direct radial exposure of the inner wall of tube 12 to arc A is prevented by the pressure of the cone 46. In a like manner, since the gases are likely to be hot, the residual heat of the arc A even after cooling by the cooling meshes M1 and M2 may raise the temperature in the regions 53 and 54. It is also to be understood that the pressure of the accumulated gas within the interior of the insulating support tube 12 may increase, at least for a short time, during the arcing process because of the presence of the arc products, for example. It is therefore desirous that the insulating support tube be relatively unaffected by the direct impingement of electrical current such as may exist in the arc A or by the presence of arc products or by the presence of the heat of the arc or by the presence of relatively high pressure gas for at least a short period of time.

Because of the unitary, i.e. single shell concept, the insulating support tube 12 must not only support most of the portions of the circuit breaker apparatus 10, but must also act as an electrical insulator between terminals 24 and 14. The tube 12 must also act as a gas containing vessel heat shield and corrosion resistive vessel. Generally, it has been found that if the inner wall of the insulating support tube 12 becomes carbonized, blistering and flaking of the inner wall surface interferes with the mechanical functions of the interrupter, which of course is undesirable. It has been found that a fiberglass tube alone will not resist carbonizing and the well-known tracking phenomenon associated therewith. It has been found that the use of a thin polytetrafluoroethylene (TEE) liner for a fiberglass main tube body resists tracking in the presence of the electrical arc, resists decomposition under the heat of the electrical arc, and resists decomposition under the influence of the arc products of the electrical arc. In addition, the substantial outer fiberglass support body resists rupture under the presence of the pressure of the various gases which are present either before or after the arcing operation.

It has been found that fluorinated polymers or fluoroplastic materials such as TFE work well in the previously described circuit breaker apparatus. TFE lined tubes are constructed by first coating a steel mandrel with either of two resin systems which will be discussed hereinafter. At this point a five mil (0.005 in.) TFE film, such as may be sold under the trademark CHEMPLAST, may be utilized. The film id etched on both sides to permit resin bonding. A sodium based etching solution may be used for the etching purpose. The etched thin film is wound on the wet mandrel employing, for example, a 50% overlap to provide a two-ply liner. While the film is being wound, it is also being continuously coated with one of the two resin systems to be discussed hereinafter. The resin systems act as a bonding agent between the plies. In the preferred embodiment of the invention the total thickness of the completed liner is 0.010 inch.

Figure 2:
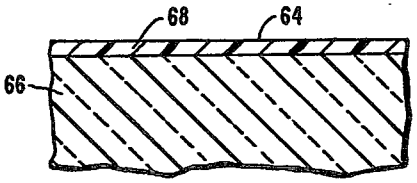

By referring to FIG. 2, in addition of FIG. 1, it can be seen that the relatively thin layer of TFE film 64 forms the inner liner for the insulating support tube 12. The remaining portion 66 (not shown to its full dimension relative to the thin film 64 in FIG. 2) may comprise type 30-E glass which is filament wound. The glass roving is wet wound using one of the previously described resins over the TFE liner. A 60° helical winding pattern may be used in a preferred embodiment of the invention. The layers of glass are built up until a wall thickness of 7/16 of an inch is achieved in a preferred embodiment of the invention. At this point the tube is gelled and cured, then after cooling, stripped from the winding mandrel.

As was mentioned previously, two resin systems have been found for use with the TFE lined, filament wound tube previously discussed. One of the resins is sold under the trademark DER 330. It is a bisphenol-A/epichlorohydrin base epoxy resin. Its desirable characteristics include hardness, toughness, and resistance to chemical attack. It also possesses high tensile and compressive strength, good chemical properties, and it adheres tenaciously to most materials including etched TFE. It is also favorably suited to structural laminates, such as filament wound pipes and vessels. The formulation and cure schedule is shown below:

DER 330–70 parts by weight
Diglycidylether of Neopentyl Glycol (DGENPG)–30 parts by weight
p,p'-Methylenedianiline (MDA)–27 parts by weight
Gel 2 hours at 175° F.
Cure 2 hours at 212° F. plus 4 hours at 300° F.

Another resin system which was found to be useful is sold under the trademark CY-179. This is a general purpose cycloaliphatic-diepoxide. When anhydride cured it features good electrical loss properties, arc and track resistance, and high heat deflection temperature. Another very desirable feature is its good resistance to weathering. Even it the puffer interrupter is to be protected from weather, in some instances dust and moisture may deposit on the outside surface of the single insulating tube 12 and electrical flashover between electrodes 24 and 14, for example, may occur. In these cases the cycloaliphatic resin is a distinct advantage because of its superior non-tracking performance. Formulation and cure schedules follow:

CY 179–100 parts by weight
Hexahydrophthalic Anhydride (HHPA)–105 parts by weight
Accelerator 065 (Ciba-Geigy)–12 parts by weight
Gel 2 hours at 175° F.
Cure 4 hours at 300° F.

The TFE lining, polytetrafluoroethylene, plays a number of important functions in the interrupter 10. The thermal stability of TFE is well known. The polymer does not melt, but rather cold flows at 620° F. and can be used continuously at 500° F. Short times at temperatures higher than 700° F. can be tolerated without the occurrence of carbonization. TFE has good arc resistance qualities. Carbon tracks are not formed. The surface friction of TFE is low and its static friction is lower than its dynamic friction. This is useful because the piston, i.e. seal 44, of the puffer rides against the inner wall of the tube 12. The latter piston comprises the conducting flange 38 with its seal 44. The products of arced sulfur hexafluoride do not react with TFE.

It is to be understood with respect to the embodiments of the invention that the relative thin lining of the tube 12 may be larger or smaller than 10/1000 inch as was cited in the illustrative example. The relatively thin film is necessary as a protective coating for the inner surface of the insulating support tube 12. It is also to be understood that the cylindrical relationships of the elements is not necessary. The tube 12 may be non-cylindrical or even angular in cross-section in other embodiments of the invention. It is also to be understood that the basic operating characteristics of the circuit breaker are not limiting except to the extent that the single tube is utilized in close proximity to an arc, or to the heat of the arc, or the products or the arc, or the pressure caused by the arc in the presence of gas. It is also to be understood that the arrangement of the terminals of the apparatus is not limiting. It is to be understood that the cooling materials M1 and M2 may comprise wound copper mesh, but is not limited thereto in either material of geometry.

The apparatus taught with respect to the embodiments of this invention have many advantages. One advantage lies in the fact that hot gas which is exited from the region of an electrical arc is cooled by either transverse or radial movement through a downstream gas cooler to remove some of the energy of the heated gas, thus tending to reduce the thermal and mechanical stress on the inside wall of the single barrel of the circuit breaker apparatus.

What we claim as our invention is:

1. A puffer circuit interrupter, comprising:

(a) insulating tube means having first and second spaced external electrical terminal means thereon, said external terminal means communicating with the internal portion of said tube means;

(b) first electrical contact means disposed within said tube means in electrical contact with said first external terminal means;

(c) second movable hollow contact means disposed within said tube means in electrical contact with said second external terminal means, said second contact means being movable into and out of contact with said first contact means;

(d) piston means fixedly disposed upon said second contact means for moving therewith to compress puffer gas in a gas compression region, said piston means having an opening therein which joins said gas compression region and an arc region which exists between said first and said second contact contact means when separated, said puffer gas flowing through said opening into said arc region as said contact means separate to effect an arc which is struck between said first and second contact means as they separate, said gas exiting from said arc region through said second hollow contact means into a gas storage region;

(e) nozzle means fixedly disposed upon said piston means outboard of said opening therein and movably disposed upon said first contact means, said nozzle means at all times being radially interposed between said arc region and said insulating tube means to protect said insulating tube means from arc effects; and (f) gas cooler means disposed within said gas storage region for cooling said puffer gas.

2. The combination as claimed in claim 1 wherein said gas diffuses radially through said gas cooler means for cooling.

3. The combination as claimed in claim 1 wherein said gas diffuses laterally through said gas cooler means for cooling.

4. A puffer circuit interrupter, comprising:

(a) insulating tube means having first and second spaced external electrical terminal means therein, said external terminal means communicating with the internal portion of said tube means;

(b) first electrical contact means disposed within said tube means in electrical contact with said first external terminal means;

(c) second movable hollow contact means disposed within said tube means in electrical contact with said second external terminal means, said second contact means being movable into and out of overlapping contact with said first contact means through a fixed overlap region;

(d) piston means fixedly disposed upon said second contact means for moving therewith to compress puffer gas in a gas compression region, said piston means having an opening therein which joins said gas compression region and an arc region which exists between said first and second contact means when said contact means do not overlap, said gas being compressed during the period in which said piston is being moved to take said second contact means out of contact with said first contact means but while both said latter contact means are in said overlap region, said puffer gas flowing through said opening into said arc region as said contact means separate to effect an arc which is struck between said first and second contact means as they separate, said gas exiting from said arc region through said second hollow contact means into a gas storage region; and (e) gas cooler means disposed within said gas storage region for cooling said puffer gas.

5. The combination as claimed in claim 4 wherein said gas diffuses radially through said gas cooler means for cooling.

6. The combination as claimed in claim 4 wherein said gas diffuses laterally through said gas cooler means for cooling.

7. A puffer circuit interrupter, comprising:

(a) insulating tube means having first and second spaced external electrical terminal means thereon, said external terminal means communicating with the internal portion of said tube means;

(b) first hollow electrical contact means disposed within said tube means in electrical contact with said first external terminal means;

(c) second movable hollow contact means disposed within said tube means in electrical contact with said second external terminal means, said second contact means being movable into and out of contact with said first contact means;

(d) piston means fixedly disposed upon said second contact means for moving therewith to compress puffer gas in a gas compression region, said piston means having an opening therein which joins said gas compression region and an arc region which exists between said first and said second contact means when separated, said puffer gas flowing through said opening into said arc region as said contact means separate to effect an arc which is struck between said first and second contact means as they separate, said gas exiting from said arc region through said first and said second hollow contact means into gas storage regions;

(e) nozzle means fixedly disposed upon said piston means outboard of said opening therein and movably disposed upon said first contact means, said nozzle means at all times being radially interposed between said arc region and said insulating tube means to protect said insulating tube means from arc effects; and (f) gas cooler means disposed within said gas storage regions for cooling said puffer gas.

8. The combination as claimed in claim 7 wherein said gas diffuses radially through said gas cooler means for cooling.

9. The combination as claimed in claim 7 wherein said gas diffuses laterally through said gas cooler means for cooling.

10. A puffer circuit interrupter, comprising:

(a) insulating tube means having first and second spaced external electrical terminal means thereon, said external terminal means communicating with the internal portion of said tube means;

(b) first hollow electrical contact means disposed within said tube means in electrical contact with said first external terminal means;

(c) second movable hollow contact means disposed within said tube means in electrical contact with said second external terminal means, said second contact means being movable into and out of overlapping contact with said first contact means through a fixed overlap region;

(d) piston means fixedly disposed upon said second contact means for moving therewith to compress puffer gas in a gas compression region, said piston means having an opening therein which joins said gas compression region and an arc region which exists between said first and said second contact means when said contact means do not overlap, said gas being compressed during the period in which said piston is being moved to take said second contact means out of contact with said first contact means but while both said latter contact means are in said overlap region, said puffer gas flowing through said opening into said arc region as said contact means separate to effect an arc which is struck between said first and second contact means as they separate, said gas exiting from said arc region through said first and said second hollow contact means into gas storage regions; and (e) gas cooler means disposed within said gas storage region for cooling said puffer gas.

11. The combination as claimed in claim 10 wherein said gas diffuses radially through said gas cooler means for cooling.

12. The combination as claimed in claim 10 wherein said gas diffuses laterally through said gas cooler means for cooling.

* * * * *